United States Patent [19]

Grinwald

[11] Patent Number: 4,723,473

[45] Date of Patent: Feb. 9, 1988

[54] DETACHABLE CONNECTION BETWEEN A MILITARY TANK AND A MINE ROLLER ASSEMBLY

[75] Inventor: Israel M. Grinwald, Oakland County, Mich.

[73] Assignee: The United States Government as represented by the Secretary of the Army, Washington, D.C.

[21] Appl. No.: 924,941

[22] Filed: Oct. 23, 1986

[51] Int. Cl.[4] ..... F41H 11/16

[52] U.S. Cl. ..... 89/1.13; 280/460 A; 280/186

[58] Field of Search ..... 89/1.13, 1.14; 280/186, 280/189, 460 R, 460 A, 477

[56] References Cited

U.S. PATENT DOCUMENTS

| | | | |
|---|---|---|---|
| 2,231,875 | 2/1941 | Behnke et al. | 89/1.13 |
| 2,614,860 | 10/1952 | Samdahl | 280/460·R |
| 3,945,295 | 3/1976 | Robison | 89/1.15 |
| 3,983,892 | 10/1976 | Hardesty | 89/1.14 |
| 4,090,567 | 5/1978 | Tomlinson | 89/7 |
| 4,167,274 | 9/1979 | Trittipoe | 280/477 |
| 4,266,795 | 5/1981 | Walker | 280/460 R |
| 4,590,844 | 5/1986 | Bar-Nefy et al. | 89/1.13 |

*Primary Examiner*—Stephen C. Bentley
*Assistant Examiner*—Stephen M. Johnson
*Attorney, Agent, or Firm*—Peter A. Taucher; John E. McRae

[57] ABSTRACT

A detachable hinge-like connection between a military tank and a mine roller assembly; the hinge connection is designed to be broken (disconnected) from a remote point, e.g. from within the tank, whereby the mine roller assembly can be left on the battlefield without exposing the tank driver to enemy fire. The hinge connection includes a hook member carried by the tank to partially encircle a hinge pin carried by the mine roller assembly. A small explosive squib is arranged to drive a latch pin out of a hole in the hook member, whereupon the hook member swings down under gravitational force, thereby breaking the hinge connection. The tank driver can detonate the explosive squib without leaving the safety of the tank.

12 Claims, 10 Drawing Figures

DETACHABLE CONNECTION BETWEEN A MILITARY TANK AND A MINE ROLLER ASSEMBLY

GOVERNMENT INTEREST

The invention described herein may be manufactured, used, and licensed by or for the Government for governmental purposes without payment to me of any royalty thereon.

BACKGROUND AND SUMMARY OF THE INVENTION

This invention relates to mechanism for detachably connecting a military tank to a mine roller assembly, whereby the tank can push the mine roller assembly over enemy territory to detonate enemy mines (on or under the ground surface). The detachable connection is designed to permit the connection to be broken by a remote electrical signal from within the tank, thereby enabling the tank to withdraw from the battlefield area, leaving the mine roller assembly behind. Such withdrawal may be necessary, e.g. if the mine roller assembly becomes wholly or partially inoperable, or if the tank is partially disabled or if the tank is needed for other purposes, or if the tank is required to escape quickly from concentrated enemy fire.

The above discussion is phrased in terms of one mine roller assembly per tank. Actually, there are two mine roller sub-assemblies per tank. These mine roller sub-assemblies are spaced laterally from one another so that the rollers in each sub-assembly occupy spaces in front of the tank treads (tracks) to detonate enemy mines in the paths taken by treads. After such mines have been detonated, friendly vehicles or troops can proceed along the two laterally spaced paths cleared by the mine roller assemblies. In most cases mines in the space between the two paths will also be detonated. In a typical situation the mine roller system will form a single mine-free path about twelve to fifteen feet wide.

For ease of discussion, the following narrative will speak about a detachable connection between a mine roller assembly and a military tank. It will be understood that in practice there are two mine roller assemblies per tank, hence two detachable connections (one for each mine roller assembly).

Detachable connections between a military tank and a mine roller assembly are already known. One such connection comprises cooperating separable hinge elements carried respectively by the tank and the mine roller assembly. These hinge elements are maintained in their operative positions by means of hook-like latch elements and swingable keepers. The swingable keepers are connected to a tie rod lying on the upper front face of the tank hull.

A fluid pump within the tank hull delivers pressurized liquid to a small hydraulic motor located on the hull surface. Motor operation moves the tie rod, to thereby release the keepers from the latch elements.

The existing connection also includes a heavy cable trained between the mine roller assembly and an anchorage on the tank hull upper surface. Should the mine roller assembly encounter a deep depression (hole or ditch) the cable will act as a temporary suspension device for the mine roller assembly, whereby the rollers are prevented from dropping so far into the depression as might impede movement of the tank.

One end of the cable has an eye structure hooked over (around) a post located on the hull upper face. A small lever is arranged near the post for upward swinging movement by the aforementioned hydraulic motor. When it becomes necessary to separate the mine roller assembly from the tank the hydraulic motor is operated to swing the lever upwardly; an end surface on the lever acts to pry the cable eye structure upwardly off of the post.

As previously noted, the hydraulic motor also operates the tie rod that releases the keepers from the latch elements. With the latch elements in their released positions (and the cable disconnected from the tank) the tank can be backed away from the mine roller assembly. The "disconnect" operation is performed without necessity for the tank driver having to leave the tank or otherwise expose himself to enemy fire.

The described pump, motor, tie rod, cable and prying lever are relatively complex and costly. Additionally, the locations of the tie rod, cable and prying lever are such that special care must be used in mounting them in place; otherwise the connector system will not function properly.

A further problem with the described system is the fact that the cable, post, lever and hydraulic motor are located on the hull upper surface substantially directly in front of the driver's observation window (vision blocks). These components tend to prevent the driver from obtaining a good view of the terrain in front of the tank-mine roller system.

Another problem with the described system is the location of the hydraulic pump. The pump is located in the driver compartment where it takes up valuable space that could be used for other purposes. The pump can be an interference (obstruction) to driver manipulation of the tank controls.

The present invention is directed to a detachable connector system for a tank-mine roller assembly, wherein the system is substantially simplier and cheaper than the above-described system. The invention also seeks to provide a system that avoids the need for a hydraulic pump or for placement of components on the hull upper face in front of the driver's observation window.

THE DRAWINGS

GENERAL ARRANGEMENT

Figure 1:
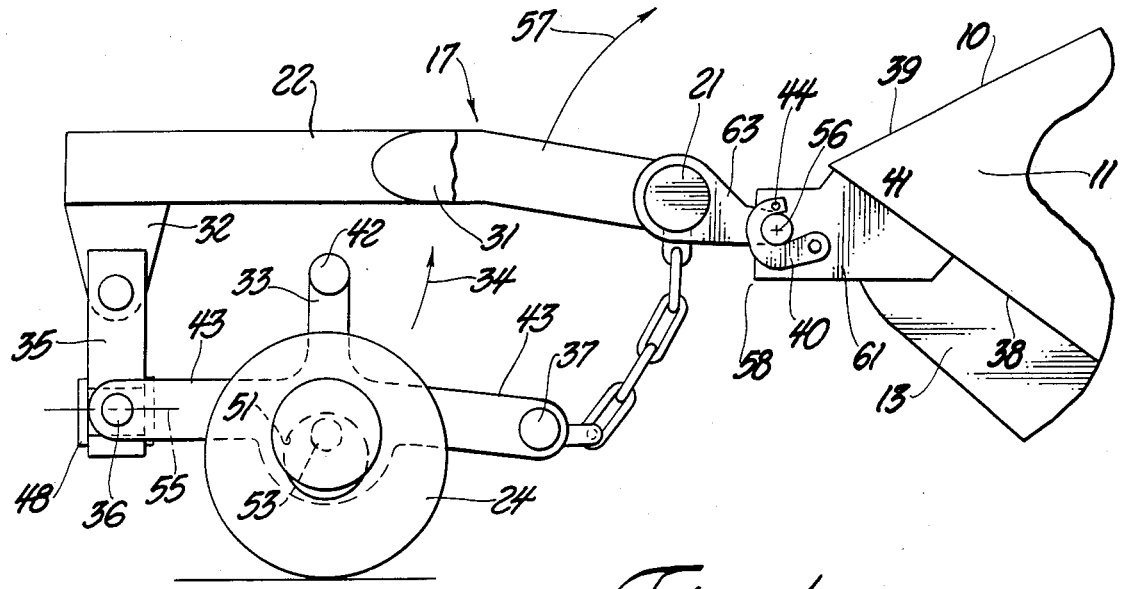
FIG. 1 is a view taken on line 1—1 in FIG. 2, illustrating one embodiment of the invention.
Figure 2:
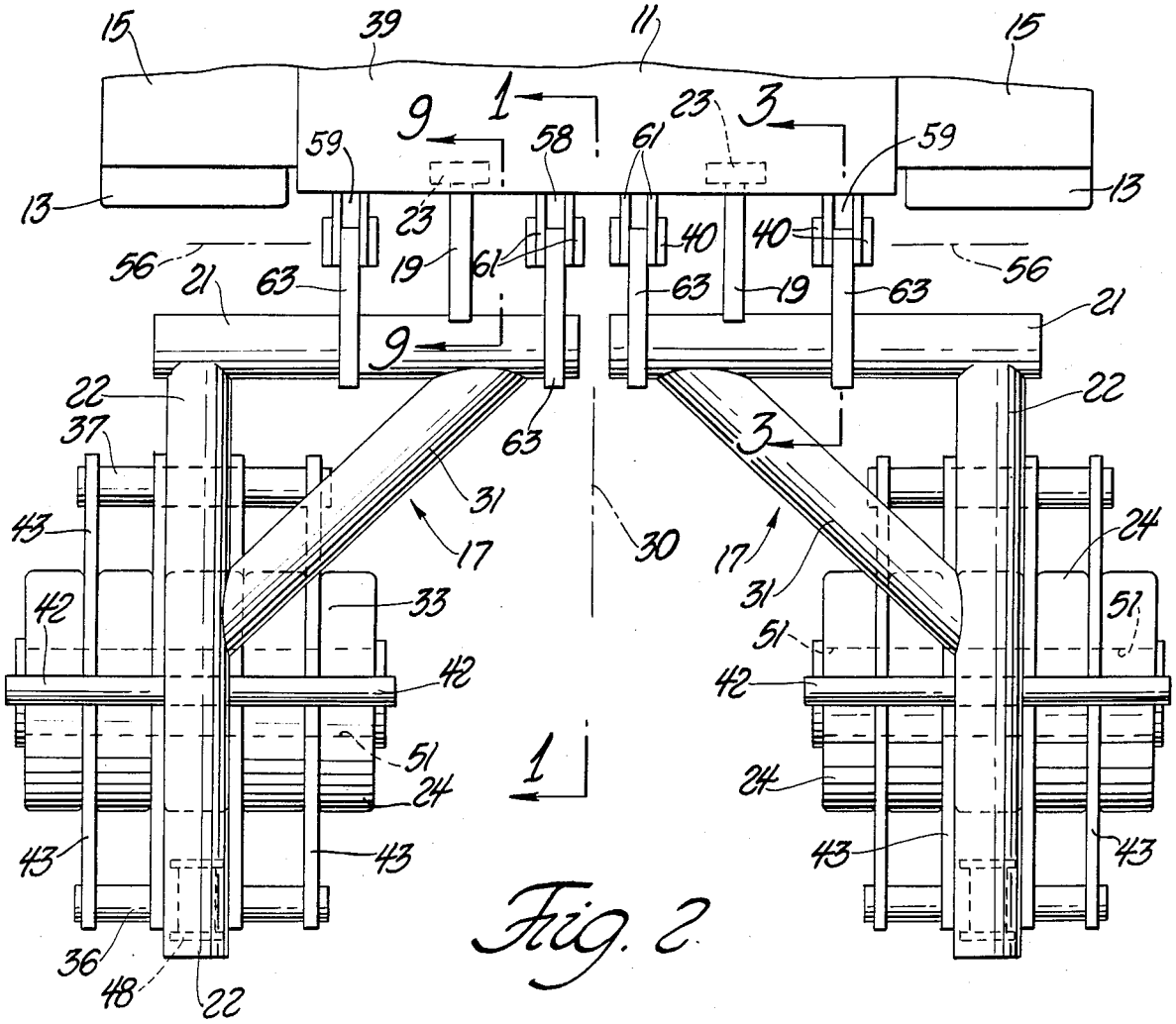
FIG. 2 is a top plan view of the FIG. 1 mechanism.

Referring in greater detail to FIGS. 1 and 2, there is shown the front end portion of a military tank 10 comprising a hull 11, tracks 13, and fenders 15. The hull has a front surface 38 and an upper surface 39. The tank may be a conventional tank used by the U.S. military under the designation M-60 (or M-1)

The space in front of the tank is occupied by two conventional mine roller assemblies 17. The assemblies are similar except that each is a mirror image of the other (relative to the tank longitudinal centerline 30). FIGS. 1 and 2 illustrate the principal features of the mine roller assemblies; the actual assemblies are somewhat more complex than shown in these drawings.

During battlefield operations the tank is driven forwardly (right-to-left in FIG. 1). such that the heavy steel rollers 24 in each mine roller assembly 17 exert their full weight on the terrain. The heavy pressure is transmitted through the earth to detonate buried enemy mines. The heavy rollers 24 are located directly in front of tank tracks 13, whereby the enemy mines are detonated before the tracks are within the danger areas.

Enemy mines in the space between the two mine roller assemblies are detonated by detonation forces generated by the mines beneath rollers 24.

MINE ROLLER ASSEMBLY STRUCTURE

Each mine roller assembly comprises a horizontal push beam (steel pipe) 21, overhead beam 22, and gusset (pipe) 31. The front end of beam 22 has a bracket 32 thereon for swingably suspending a carriage structure 33 so that the carriage can lift upwardly from its illustrated position, as indicated by arrow 34 (by blast forces or miner hills).

Each carriage includes a depending link 35, front cross bar 36, rear cross bar 37, and upper cross bar 42. Four yoke plates 43 are welded or otherwise rigidly secured to the three cross bars. The connection 48 between link 35 and cross bar 36 is a swivel connection that permits the plate-cross bar assembly to rock around a longitudinal axis 55 normal to bar 36.

Five heavy steel rollers 24 are floatably connected to carriage structure 33. Each roller has an enlarged hole 51 therethrough; a cross shaft 53 is connected to yoke plates 43 to extend through holes 51, to thereby maintain the rollers in engagement with the carriage structure, while at the same time permitting the full roller weight to be applied to the terrain surface.

Each mine roller assembly is hingedly connected to tank 10 so that the mine roller assembly can swing in a vertical plane about a transverse horizontal axis 56 located at the rear end of the assembly. Should heavy rollers 24 encounter an enemy mine the resulting blast will forcibly lift the entire assembly from its illustrated position, as designated by arrow 57 in FIG. 1. During "sidehill" operations over hilly terrain the mine roller assembly may rock transversely around pivot axis 55 (in accordance with the terrain contour).

HINGE CONSTRUCTION

The connecting hinge mechanism (between the tank and each mine roller assembly) comprises two separate hinge assemblies 58 and 59 spaced laterally from one another along the length or push beam 21. These hinge assemblies are structurally identicals therefore a description of to will suffice for a description of the other. suffice for a description of the other.

Figure 3:
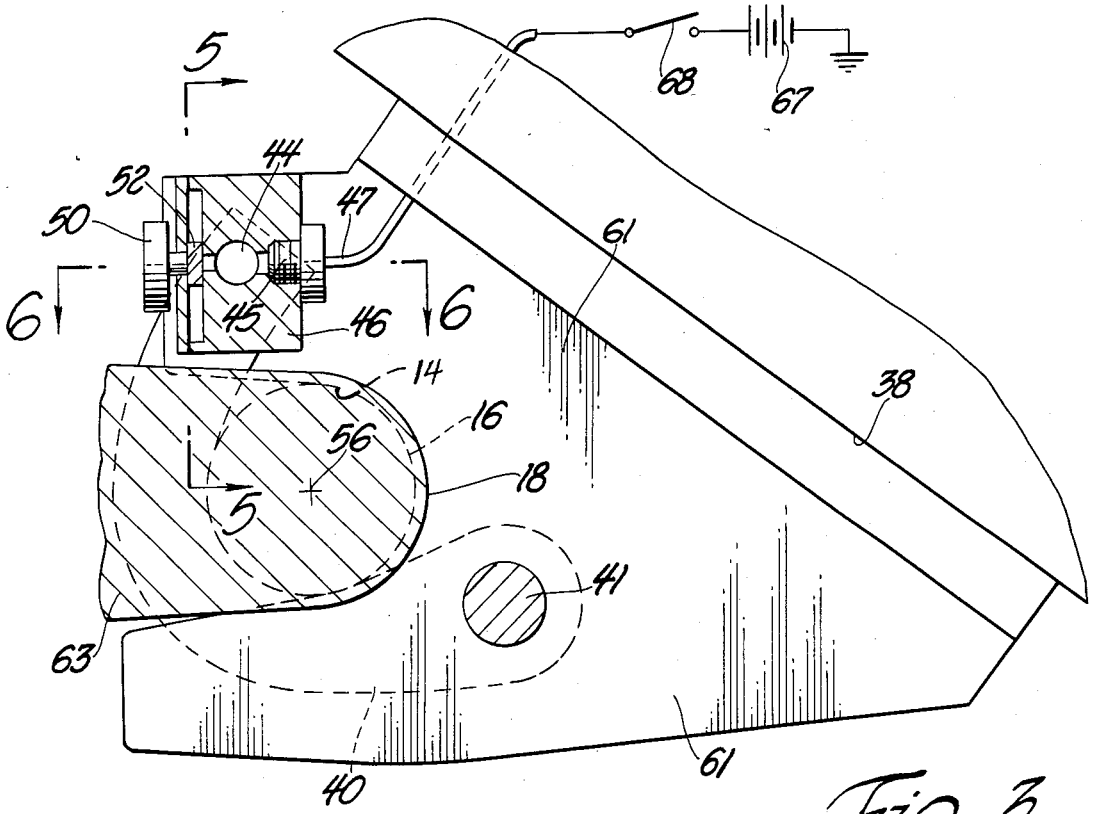
FIG. 3 is an enlarged fragmentary sectional view taken on line 3—3 in FIG. 2.
Figure 4:
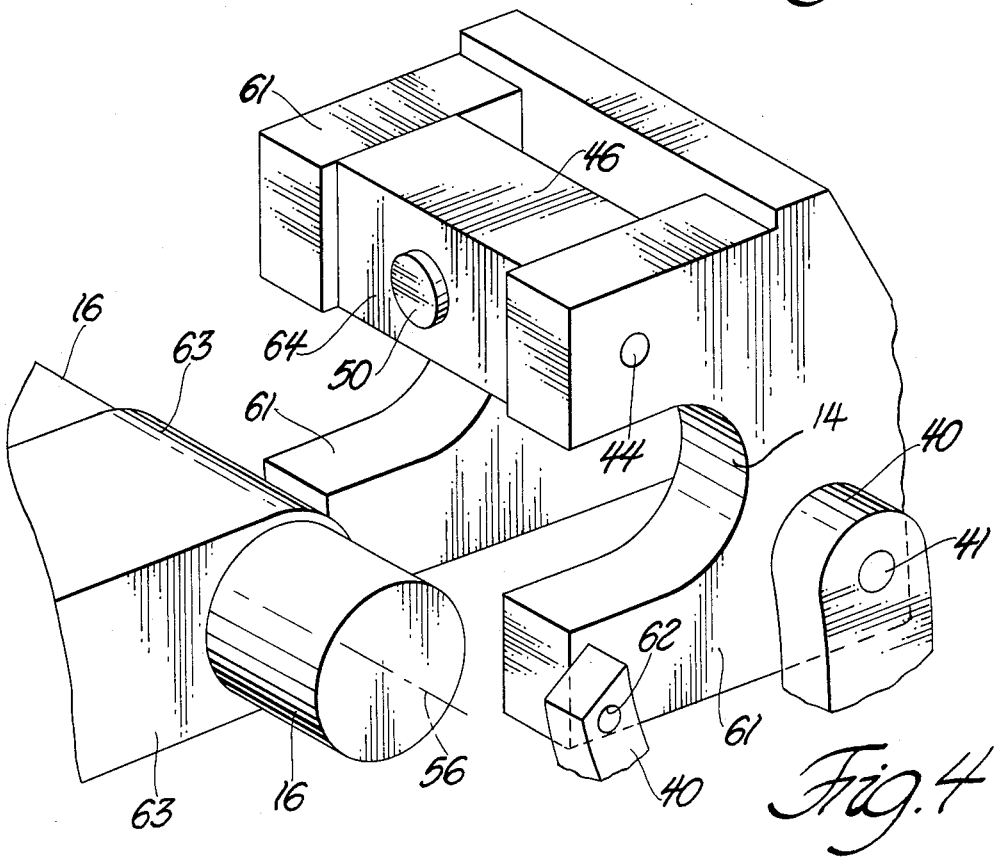
FIG. 4 is fragmentary perspective view of certain hinge elements utilized in the FIG. 1 embodiment, shown in disconnected conditions.
Figure 5:
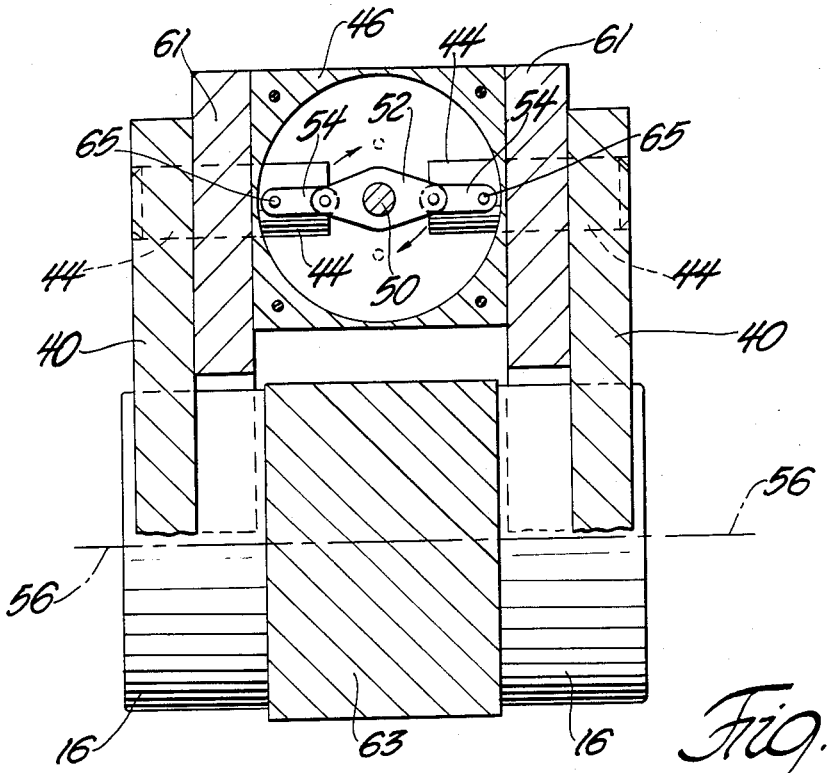
FIG. 5 is a fragmentary sectional view taken on line 5—5 in FIG. 5.

Illustrative hinge mechanism 58 comprises two laterally spaced plates (or arms) 61 permanently connected to tank hull 11; each plate 61 has the configuration depicted in FIGS. 3 and 4. Plates 61 are spaced apart a sufficient distance to accommodate therebetween a plate (or arm) 63 that extends rearwardly from push-beam 21 (not visible in FIGS. 3 and 4). Plate 63 has two laterally-extending hinge pins 16 designed to seat within forwardly-facing notcher 14 in plates 61 (when plate 63 is positioned between plates 61). The rear surface areas of notches 14 are curved to conform to the surface curvatures on pins 16. The center axis of pins 16 defines the aforementioned hinge axis 56 (FIGS. 1 and 2).

LATCH MECHANISM

FIGS. 3 through 6 illustrate features of a latch mechanism carried by plates 61 to releasably engage hinge elements 16 (carried by the mine roller assembly), thereby maintaining the hinge assembly in an operating condition.

Hinge pins 16 are longer than the thickness of plates 61. Therefore the pins extends beyond plates 61 (FIG. 3 position). Hinge pins 16 are releasably retained in notches 14 by hook members 40 that are swingably attached at 41 to plates 61. In the FIG. 3 positions the curved concave surfaces of hook members 40 partially encircle pins 16 to prevent movement thereof out of notches 14. Hook members 40 constitute latch means for releasably retaining hinge elements 16 in "connected" relationship with hinge elements 61.

KEEPER MECHANISM 64

Hook members 40 are maintained in their FIG. 3 positions by means of an electrically-operated keeper mechanism 64. Mechanism 64 includes a housing 46 suitably secured to plates 61. Two pins 44 are slidably positioned in housing 46 for outward (lateral) movements to the FIG. 6 position. In such positions pins 44 extend into circular holes 62 in hook members 40, whereby pins 44 prevent downward swinging motions of members 40 around swing axis 41.

Pins 44 have pivotal connections 65 with links 54 that in turn are pivotably connected with a plate-like lever 52 that is carried on the shaft portion of a rotary knob 50. When knob 50 is manually rotated in a clockwise direction (FIG. 5) lever 52 rotates to draw links 54 toward the vertical centerline of housing 46. Pins 44 are thereby drawn inwardly out of holes 62 in hook members 40. Hook members 40 can then swing down to the FIG. 4 "disconnected" position (by gravitational forces). Reverse manual rotation of knob 50 returns pins 44 to their operating positions extending into holes 62 in hook members 40 (assuming the hook members are first manually lifted to the FIG. 3 positions). Knob 50 is operated primarily during initial hook-up of the mine roller assembly to the tank.

Preferably hook members 40 are rigidly interconnected for conjoint movement together. Such a rigid interconnection may be provided by the pivot shaft 41 (FIG. 6).

An electrically-energized explosive squib 45, of conventional design, is mounted in housing 46 such that when an electrical signal is delivered through electrical line 47 (from a remote voltage source) an explosive pressure is generated in space 49. A typical squib 45 includes a small casing containing a miniature heating coil and a mass of explosive powder. The squib casing is externally threaded for removal/replacement purposes in housing 46.

Figure 6:
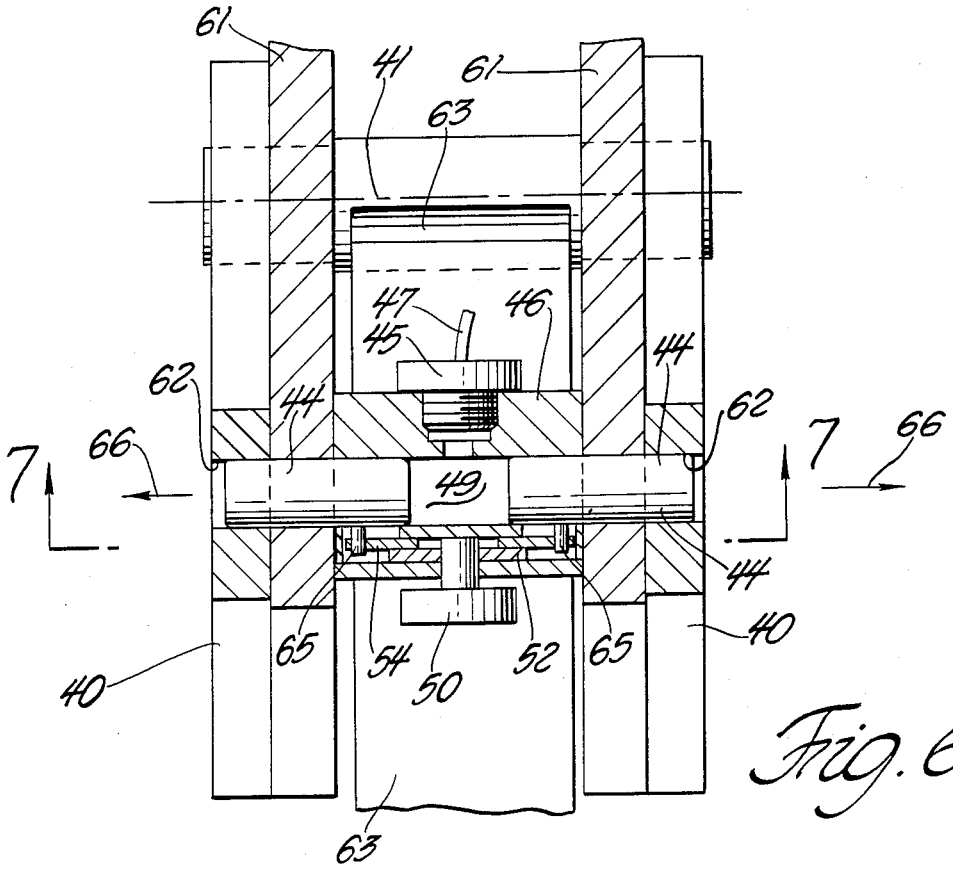
FIG. 6 is a fragmentary sectional view taken on line 6—6 in FIG. 3.

When an explosive pressure is generated in space 49 the step pressure increase causes pins 44 to be forced out of holes 62 in hook members 40, as indicated by arrows 66 in FIG. 6. The aforementioned pin connections 65 are constructed as shear pins, whereby such pin connections are severed by the blast forces on the inner ends of keeper pins 44.

With pins 44 driven out of holes 62 the hook members 40 gravitationally drop down to the FIG. 4 "disconnected" positions. Tank 10 can then be backed away from the mine roller assembly 17 (FIGS. 1 and 2), to leave the mine roller assembly on the battlefield. In actual practice, there are two mine roller assemblies 17, as shown in FIG. 2. The hinge elements 61 and 63 for each of the four hinge assemblies (58,58,59,59) may be disconnected simultaneously by an appropriate electrical signal through each electrical line 47 (one for each squib 45).

FIG. 3 schematically illustrates a suitable control system. Voltage source 67 (in the tank) is connected to line 47 via a manual switch 68. Manual operation of the switch detonates squib 45. The switch is located within the tank in a position within the driver's reach. Line 47 has a position located outside the tank and a portion within the tank. The exterior portion of line 47 is preferably encased within an armor sheath, not shown. If necessary two switches 68 can be used (one switch for the right hand mine roller assembly, and another switch for the left hand assembly).

Keeper mechanism housing 46 may be detachably mounted on plates 61 in order to permit replacement thereof with a new housing 46 after each detonation of squib 45.

ALTERNATIVE KEEPER MECHANISM FIGS. 7 AND 8

Figure 7:
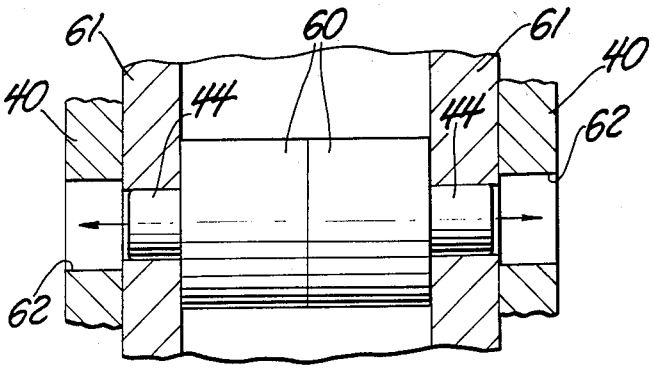
FIG. 7 is a view similar to FIG. 5, but illustrating another form of the invention.
Figure 8:
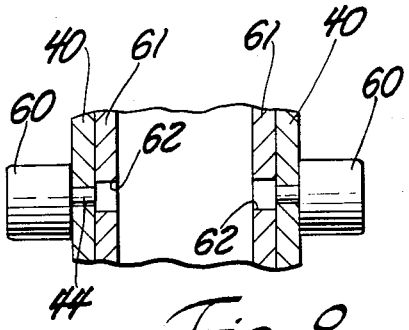
FIG. 8 is a view of another form of the invention (similar to FIG. 7), but taken on a reduced scale.

FIGS. 7 and 8 fragmentarily illustrate a latch mechanism that is identical with the mechanism shown in FIGS. 3 through 6, except that the associated keeper means has solenoid actuators rather than an explosive squib actuator. FIG. 7 shows two solenoids 60 having armatures 44 of pin-like character. When the solenoids are actuated pins 44 are moved inwardly from holes 62 to the FIG. 7 positions. The FIG. 7 structure does not include a manual actuator corresponding to knob 50 (FIG. 6).

FIG. 8 is essentially the reverse of FIG. 7, i.e., solenoids 60 are mounted on hook members 40 (outside the space between plates 61). Energization of the solenoids causes pins 44 to move out of holes 62 in plates 61.

STOP STRUCTURE (FIGS. 9 AND 10)

Figure 9:
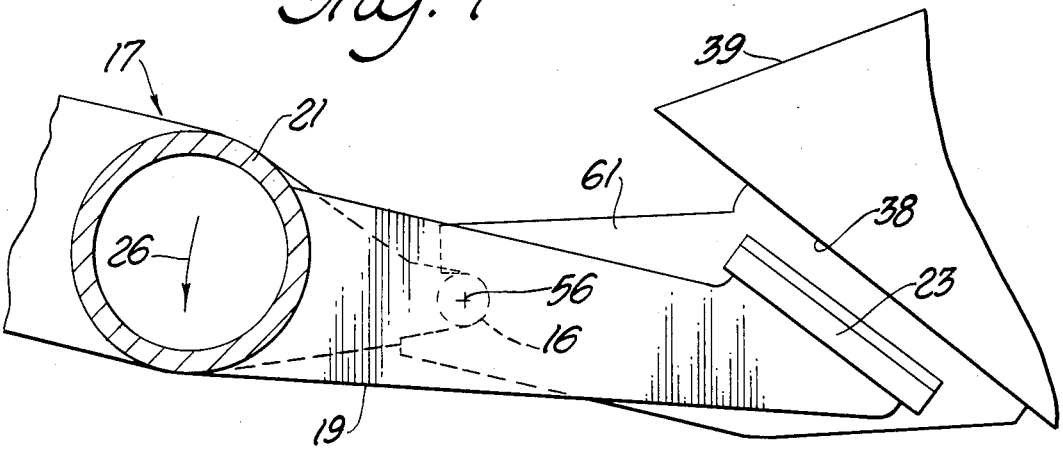
FIG. 9 is an enlarged fragmentary sectional view on line 9—9 in FIG. 2
Figure 10:
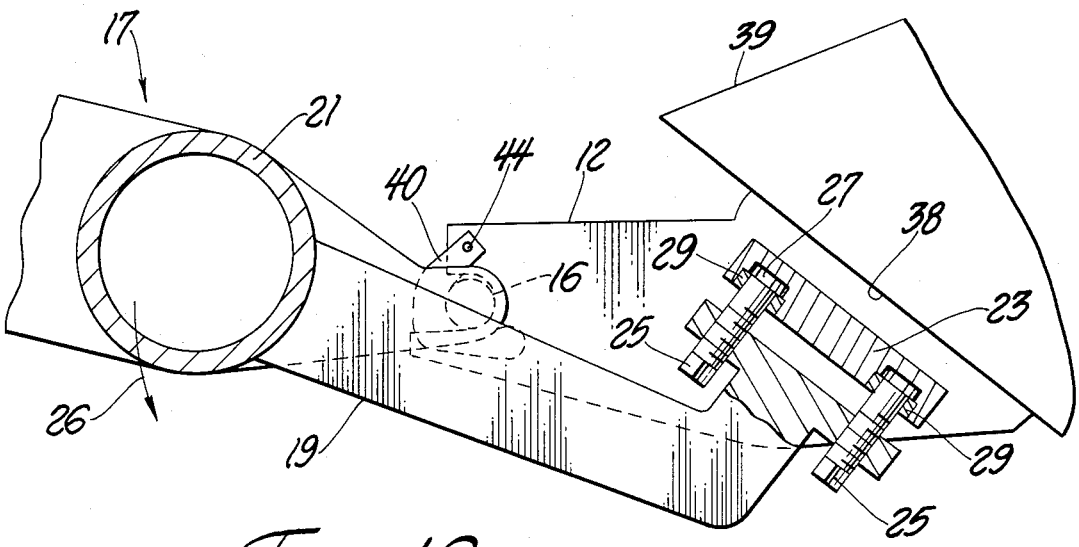
FIG. 10 is a view taken in the same direction as FIG. 9, but illustrating further form that the invention can take.

FIGS. 9 and 10 illustrate two forms of a stop structure carried by the mine roller assembly for limiting downward swinging motion of the assembly around swing axis 56. As seen in FIG. 9, the stop structure comprises a plate-like strut 19 projecting rearwardly from beam 21. The rear end of strut 19 has a shoe 23 welded or otherwise affixed thereto.

Should the rollers 24 in the mine roller assembly encounter a deep ditch or similar depression the assembly will tend to swing downwardly around swing axis 56, as denoted by arrow 26. Shoe 23 will swing upwardly to forcibly engage the tank front surface 38.

The stop structure of FIG. 10 is similar to that shown in FIG. 9 except that shoe 23 is adjustably mounted on strut 19, e.g., by means of set screws 25. The enlarged heads 27 on screws 25 have loose swivel engagement in sockets formed in the lower face of shoe 23; annular inserts 29 are press fit into shoe 23 to loosely retain screws 25 in operative connection with shoe 23.

Screws 25 may be selectively or collectively threaded up or down in the associated holes in strut 19, to adjust the spacing and attitude of shoe 23 relative to tank surface 38. The aim is to ensure that when mine roller assembly 17 has swung down a predetermined distance (arrow 26) shoe 23 will hit flat against the tank surface, thereby suspending the mine roller out of any deep depressions in the terrain that might impede forward motion of the tank.

The adjustment structure of FIG. 10 is primarily to overcome manufacturing tolerances that could vary the swing stroke of the mine roller assembly (e.g., slight variations in pin 16—surface 38 spacing). During actual operations the FIG. 10 structure operates in the same fashion as the FIG. 9 structure. In both cases the shoe preferably has a fairly large face area in registry with the tank surface.

FIG. 2 shows one strut 19 for each mine roller assembly. Since the mine roller assembly is a relatively heavy piece of equipment, it might be necessary to use two such struts for each mine roller assembly.

The stop structures of FIGS. 9 and 10 are designed so as not to interfere with separation of the tank from the mine roller assembly during battlefield operations, e.g., when squib 45 is detonated.

The principal advantage of the arrangements shown in FIGS. 3 through 9 is low manufacturing cost. However there may also be some performance advantages. For example, with the illustrated arrangement the tank hull upper surface 39 (FIG. 1) is entirely unencumbered. This is not true of the known prior art arrangements; in such arrangements tank surface 39 is encumbered with cables, tie rods, cable anchorages, and hydraulic actuators required to perform the functions of the structures shown in attached FIGS. 3 through 10. Encumberances on tank surface 39 adversely interfere with the driver's forward vision.

The present arrangement may also be an advantage in that it is an electrically-operated mechanism. The known prior art arrangements have required the use of a hydraulic pump in the driver compartment. The pump takes up space in an already-crowded driver compartment. Elimination of the pump could make some space available for other purposes.

I wish it to be understood that I do not desire to be limited to the exact details of construction shown and described for obvious modifications will occur to a person skilled in the art, without departing from the spirit and scope of the appended claims.

I claim:

1. In association with a military tank and a mine roller assembly located in front of the tank for movement over enemy terrain to detonate enemy land mines: the improvement comprising means for detachably connecting said mine roller assembly to said tank; said connecting means comprising a first hinge element permanently carried by the tank and a second hinge element permanently carried by the mine roller assembly, said first and second hinge elements being connectable to permit the mine roller assembly to swing in a vertical plane about a horizontal hinge axis transverse to the direction of tank travel; said first and second hinge elements being separable to permit the tank to leave the mine roller assembly on the battlefield; latch means carried by the tank to releasably engage said second hinge element for thereby retaining said first and second hinge elements in their connected positions; electrically-operated keeper means for releasing the latch means from operative connection with the second hinge element; electric switch means located within the tank for remotely energizing the keeper means; and a stop structure carried by the mine roller assembly for limiting downward swing movement of said mine roller assembly; said stop structure comprising a strut projecting rearwardly from the mine roller assembly into near adjacency with a front end surface of the tank, whereby when the mine roller assembly swings downwardly the strut moves upwardly to forcibly engage the tank front surface.

2. The improvement of claim 1 wherein the stop structure includes a shoe carried on a free end of the strut to engage the tank surface; said shoe having an extensive face area in registry with the tank surface.

3. The improvement of claim 2 wherein the shoe is adjustably mounted on the strut to permit adjustments in the spacing between the shoe face and tank surface.

4. In association with a military tank and a mine roller assembly located in front of the tank for movement over enemy terrain to detonate enemy land mines: the improvement comprising means for detachably connecting said mine roller assembly to said tank; said connecting means comprising a first hinge element permanently carried by the tank and a second hinge element permanently carried by the mine roller assembly, said first and second hinge elements being connectable to permit the mine roller assembly to swing in a vertical plane about a horizontal hinge axis transverse to the direction of tank travel; said first and second hinge elements being separable to permit the tank to leave the mine roller assembly on the battlefield; latch means carried by the tank to releasably engage said second hinge elements for thereby retaining said first and second hinge elements in their connected positions; electrically-operated keeper means for releasing the latch means from operative connection with the second hinge element; and electric switch means located within the tank for remotely energizing the keeper means; said first hinge element comprising two laterally-spaced arms projecting forwardly from the tank, said arms having forwardly-facing notches therein defining semi-circular bearing surfaces; said second hinge element comprising a plate projecting rearwardly from the mine roller assembly, and two circular pins projecting laterally from side surfaces of the plate for entry into said notches when the plate is positioned between the spaced arms; said latch means comprising two hook members swingably mounted on the laterally-spaced arms to partially encircle end areas of the circular pins when said pins are seated within the notches; the swing axis for the hook members being located below and behind the hinge axis defined by the notches, whereby the hook members are required to swing upwardly to reach positions encircling the circular pins; said keeper means comprising a housing located in the space between the laterally-spaced arms, two additional pins slidably guided in the housing for transverse movements parallel to the hinge axis when the hook members are in position to encircle the circular pins; said hook members having openings therein adapted to register with the two additional pins, whereby the hook members are effective to lock the aforementioned circular pins in the notches; and an explosive force in the space between said two additional pins, thereby driving said two additional pins out of the openings in the hook members, such that the hook members are enabled to swing downwardly to free the circular pins for movement out of the notches.

5. The improvement of claim 4 wherein said keeper means further comprises a manual-operator mounted on said housing for manually shifting the two additional pins into and out of the openings in the hook members; the connections between the manual operator and the two additional pins comprising shear pin connections that are severed by the explosive forces on the pins.

6. In association with a military tank and a mine roller assembly located in front of the tank for movement over enemy terrain to detonate enemy land mines: the improvement comprising means for detachably connecting said mine roller assembly to said tank; said connecting means comprising a first hinge element permanently carried by the tank and a second hinge element permanently carried by the mine roller assembly, said first and second hinge elements being connectable to permit the mine roller assembly to swing in a vertical plane about a horizontal hinge axis transverse to the direction of tank travel; said first and second hinge elements being separable to permit the tank to leave the mine roller assembly on the battlefield; latch means carried by the tank to releasably engage said second hinge element for thereby retaining said first and second hinge elements in their connected positions; electrically-operated keeper means for releasing the latch means from operative connection with the second hinge element; and electric switch means located within the tank for remotely energizing the keeper means; said first hinge element comprising two laterally-spaced arms projecting forwardly from the tank, said arms having forwardly-facing notches therein defining semi-circular bearings surfaces; said second hinge element comprising a plate projecting rearwardly from the mine roller assembly, and two circular pins projecting laterally from side surfaces of the plate for entry into the notches when the plate is positioned between the spaced arms; said latch means comprising two swingable hook members mounted on the laterally-spaced arms to partially encircle end areas of the circular pins when said pins are seated within the notches; the swing axis for the hook members being located below and behind the hinge axis defined by the notches, whereby said hook members are required to swing upwardly to reach positions encircling the circular pins; said keeper means comprising two additional pins oriented above the hinge axis for transverse movements parallel to the aforementioned hinge axis when the hook members are in position to encircle the circular pins; said two additional pins being movable to lock and unlock the hook members relative to the laterally-spaced arms.

7. The improvement of claim 6 wherein said keeper means comprises electrically-energized actuator means located between the two laterally-spaced arms; said actuator means being operatively connected with said two additional pins to move them through the arms into and out of openings formed in the hook members.

8. The improvement of claim 7 wherein said actuator means comprises an explosive squib actuator.

9. The improvement of claim 8 wherein said keeper means comprises a housing defining guide surfaces for said two additional pins, said housing also defining a support surface for said explosive squib actuator.

10. The improvement of claim 9 wherein said housing defines an interior space communicating the squib actuator with end areas of said two additional pins, whereby explosive pressure is applied against end areas of the pins to drive them in opposite directions through the openings in the hook members.

11. The improvement of claim 9 wherein said keeper means comprises a manual operator for moving said two additional pins into and out of the openings in the hook members.

12. The improvement of claim 11 wherein the keeper means comprises shear pin connections between said manual operator and said two additional pins.

* * * * *